US008172731B1

(12) United States Patent
Bredda

(10) Patent No.: US 8,172,731 B1
(45) Date of Patent: May 8, 2012

(54) GRIDIRON POWER MACHINE SYSTEM

(76) Inventor: Ren Bredda, Wisconsin Rapids, WI (US)

( * ) Notice: Subject to any disclaimer, the term of this patent is extended or adjusted under 35 U.S.C. 154(b) by 0 days.

(21) Appl. No.: 12/804,102

(22) Filed: Jul. 14, 2010

(51) Int. Cl.
*A63B 21/06* (2006.01)

(52) U.S. Cl. ..... 482/94; 482/97

(58) Field of Classification Search ..... 482/92–103, 482/133–139; 473/438, 441–445
See application file for complete search history.

(56) References Cited

U.S. PATENT DOCUMENTS 3,822,599 A * 7/1974 Brentham ..... 482/113
4,241,913 A * 12/1980 Zwayer et al. ..... 482/113
4,357,010 A * 11/1982 Telle ..... 482/97
5,362,297 A * 11/1994 Muir ..... 482/134
5,637,063 A * 6/1997 Fuller, Sr. ..... 482/97
7,029,426 B1 * 4/2006 Fuller, Sr. ..... 482/97
7,104,936 B2 * 9/2006 Karlstrom ..... 482/137
7,976,439 B2 * 7/2011 Abelbeck ..... 482/93
2002/0037792 A1 * 3/2002 Smith ..... 482/92
2008/0261786 A1 * 10/2008 Laramore ..... 482/124
2009/0098986 A1 * 4/2009 Quinn ..... 482/100
2009/0203505 A1 * 8/2009 Kroll et al. ..... 482/104

* cited by examiner

*Primary Examiner* — Loan Thanh
*Assistant Examiner* — Daniel F Roland

(57) ABSTRACT

A support assembly has laterally spaced horizontal base rails. The support assembly has laterally spaced vertical rails. The vertical rails extend upwardly from the base rails. The front vertical rails house a safety rod to catch the pivot rails. Pivot rails have interior ends and exterior ends. The interior ends are pivotally coupled with respect to the vertical rails. A cross bar is coupled to the pivot rails adjacent to the exterior ends. A plate is coupled to the pivot rails adjacent to the interior ends. The plate has recesses. The recesses receive and support attachments.

4 Claims, 5 Drawing Sheets

FIG. 3
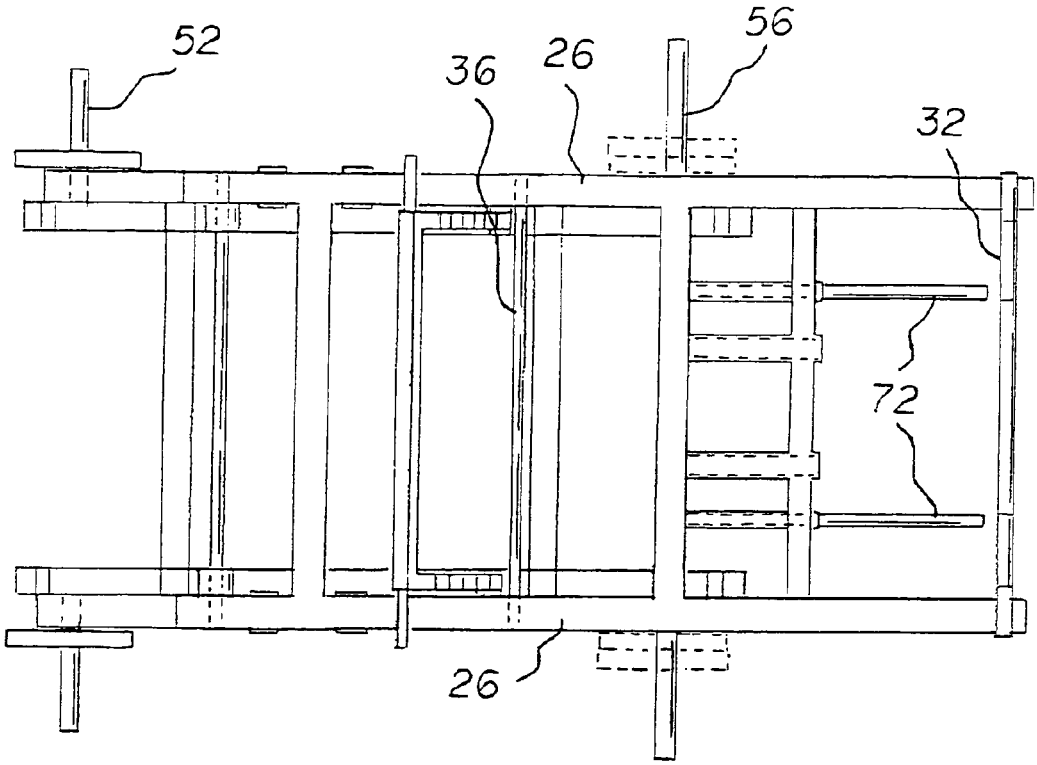
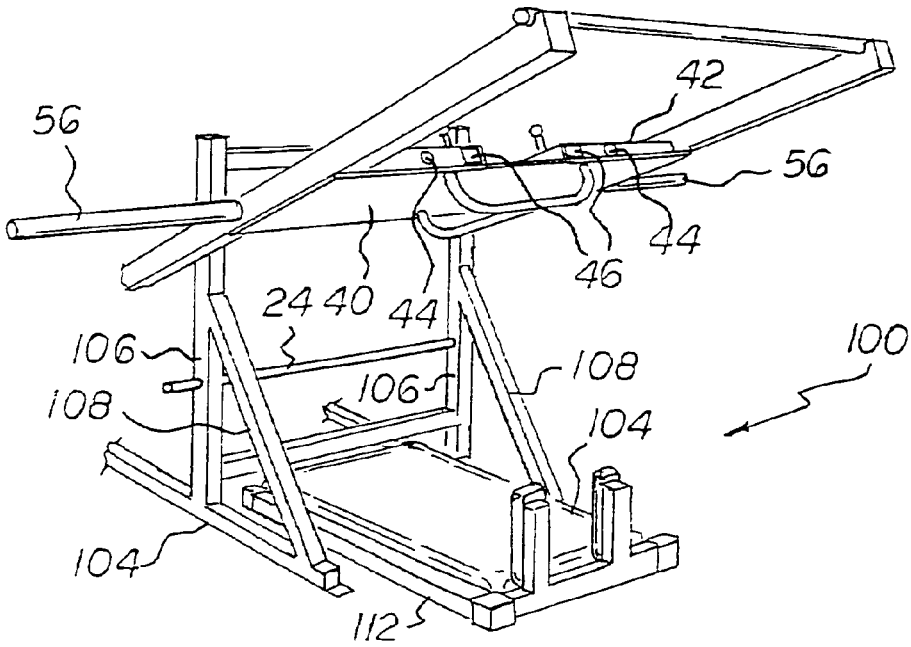
FIG. 4

FIG. 5
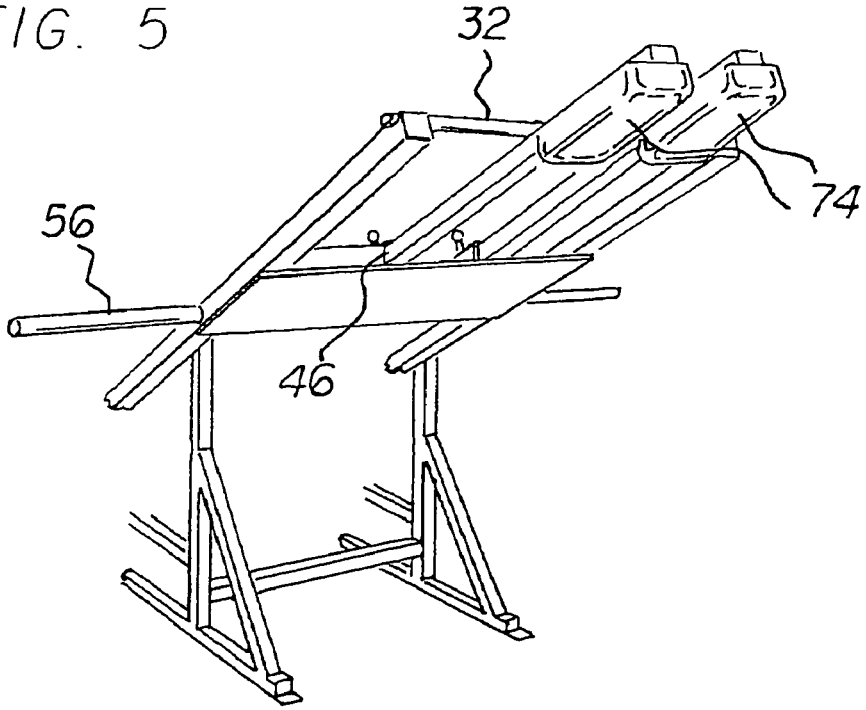
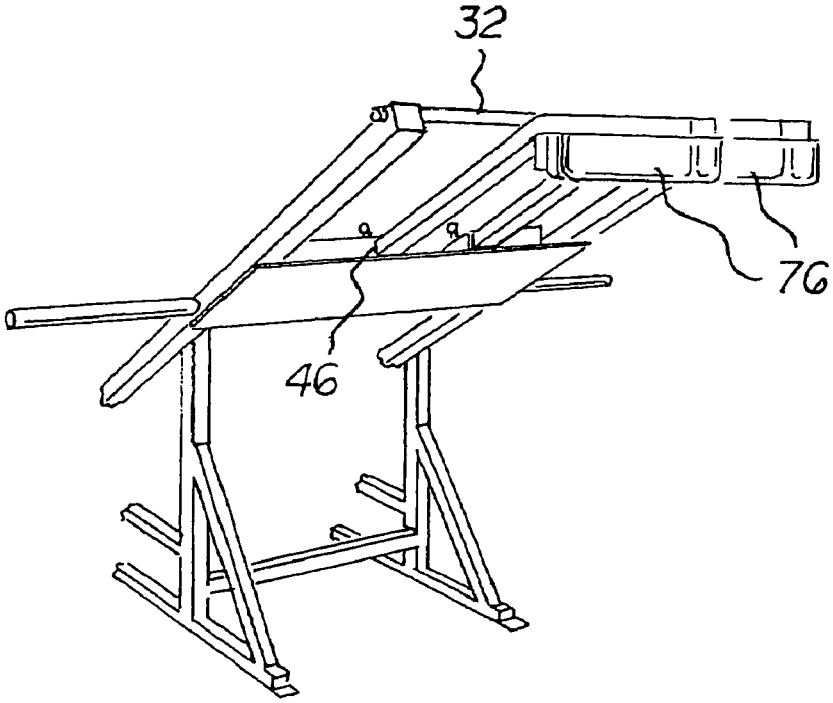
FIG. 6

FIG 7
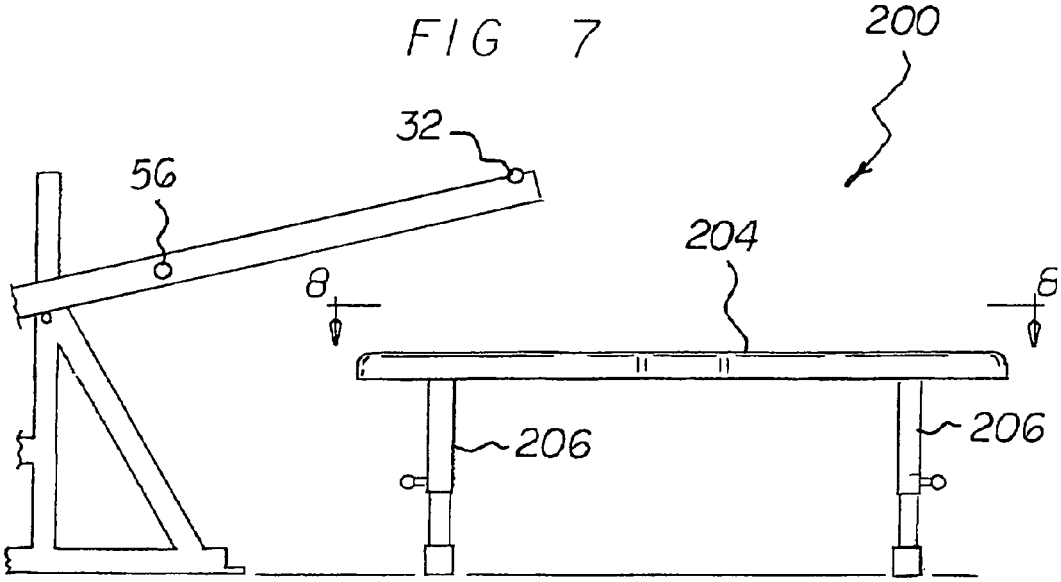
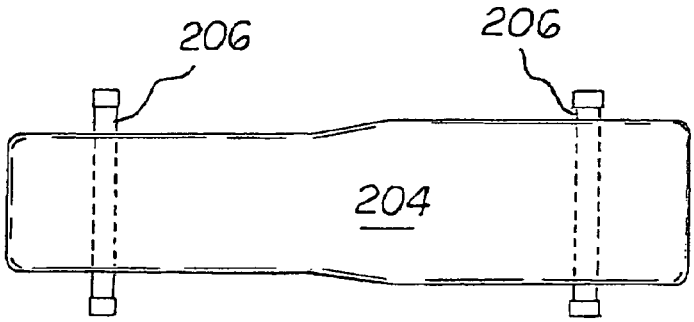
FIG 8

FIG. 9
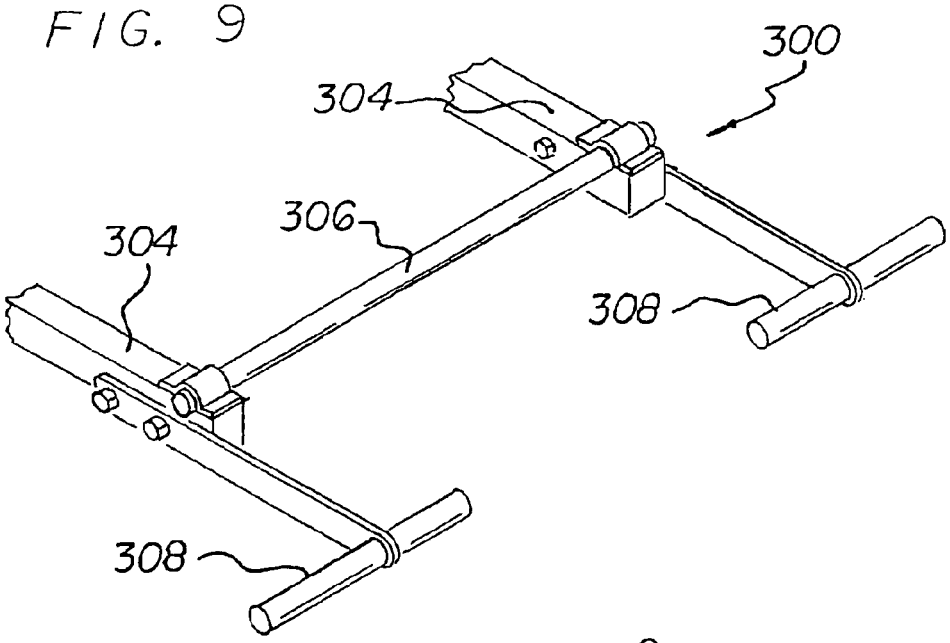
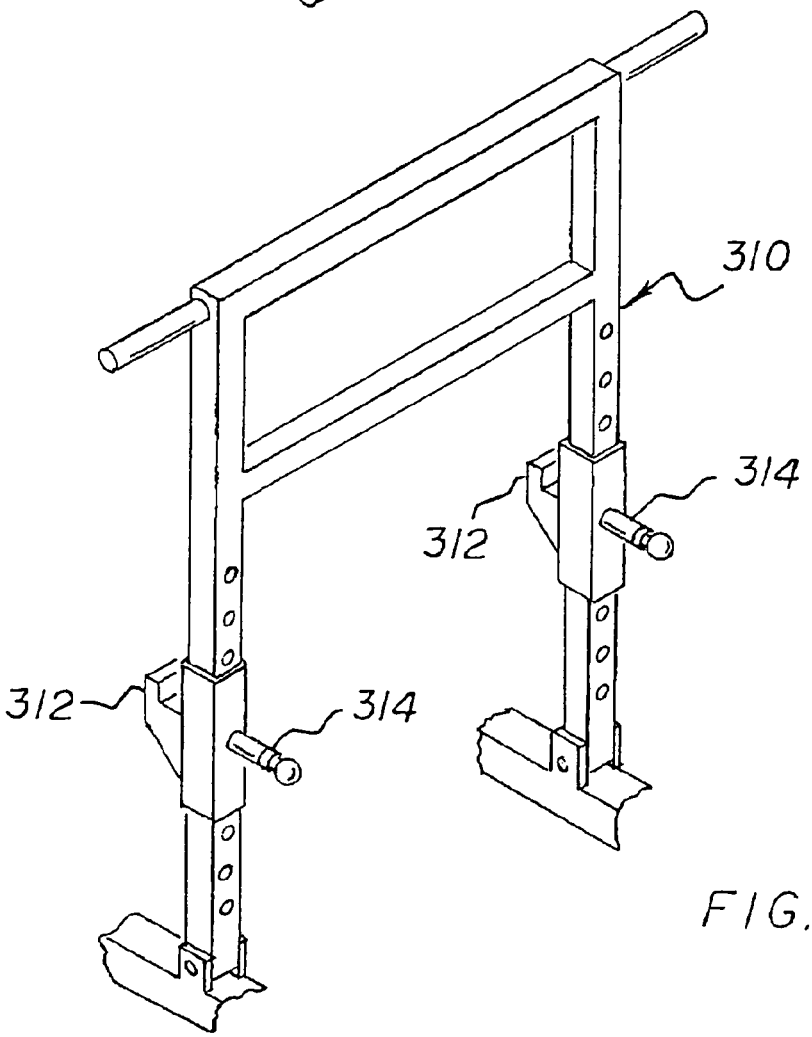
FIG. 10

GRIDIRON POWER MACHINE SYSTEM

BACKGROUND OF THE INVENTION

Field of the Invention

The present invention relates to a gridiron power machine system and more particularly pertains to being adapted to be reconfigured for providing users with a large number of lifting exercises, the lifting and reconfiguring of the system being done in a safe, convenient and economic manner.

SUMMARY OF THE INVENTION

In view of the foregoing disadvantages inherent in the known types of exercise machines of known designs and configurations now present in the prior art, the present invention provides an improved gridiron power machine system. As such, the general purpose of the present invention, which will be described subsequently in greater detail, is to provide a new and improved gridiron power machine system and method which has all the advantages of the prior art and none of the disadvantages.

To attain this, the present invention essentially comprises a gridiron power machine system. First provided is a support assembly. The support assembly has laterally spaced horizontal base rails. The base rails are positionable on a ground surface. The support assembly also has laterally spaced vertical front rails which house a safety rod. The support assembly has laterally spaced vertical rear rails. The rear rails extend upwardly from the base rails. The support assembly also has horizontal elevated rails. The elevated rails are provided above and parallel with the base rails. The elevated rails couple the vertical front rails and vertical rear rails. The support assembly also has horizontal crossing rails. The crossing rails are provided at an elevation between the base rails and elevated rails perpendicular to both the base rails and the elevated rails. In this manner the vertical front rails are coupled to vertical rear rails.

A pair of laterally spaced pivot rails is provided. The pivot rails have interior ends and exterior ends. A rear pivot pin is provided. The rear pivot pin pivotally couples the interior ends of the pivot rails to the vertical rear rails.

Provided next is a grasping cross bar. The grasping cross bar is coupled to the pivot rails adjacent to the exterior ends. The grasping cross bar is adapted to be grasped by the user. The grasping cross bar is further adapted to be lifted for exercise purposes. The exercises include a shoulder press, lineman combine press, back squat, dead lift, hand clean, bentover row and bench press.

A supplemental cross bar is provided. The supplemental cross bar is coupled to the pivot rails intermediate the exterior ends and interior ends of the pivot rails.

A plate is provided. The plate is coupled to the pivot rails intermediate the supplemental cross bar and the exterior ends of the pivot rails. The plate has an outwardly facing edge. The plate has circular recesses. The plate also has rectangular recesses. The plate is adapted to be lifted. In this manner, vertical angled leg presses may be performed. Note FIGS. 4 and 5.

A counter weight assembly is provided next. The counter weight assembly is attached to the pivot rails between the interior ends and exterior ends. The counter weight assembly extends rearwardly from the interior ends of the pivot rails. The counter weight assembly includes outwardly extending cylindrical rods.

Supplemental rods are provided next. The supplemental rods extend outwardly from the pivot rails. In this manner supplemental weights are received and supported. A plurality of weights are adapted to be selectively positioned on the cylindrical rods and supplemental rods. In this manner the weight to be lifted may be varied.

Further provided are pivotable locking rails. The pivotable locking rails have upper and lower ends. Front pivot pins are provided. The front pivot pins couple the lower ends of the pivotable locking rails to the elevated rails adjacent to the vertical front rails. Each locking rail has a plurality of L-shaped fingers. The L-shaped fingers are adapted to receive and retain the supplemental cross bar. In this manner the grasping bar may be retained at a preselected elevation. When lifted, the pivotable locking rail automtically falls back out of the way, making it an automatic un-racking system, A.U.S.

Provided last are detachable components. The detachable components include longitudinal cylindrical bars. The longitudinal cylindrical bars are positionable in the circular recesses. In this manner pole deads and pole shrugs may be performed. Note FIG. 3. The detachable components include linear bars with padding. The linear bars are positionable in the rectangular recesses. In this manner lineman plys and lineman squats may be performed. Note FIG. 5. The detachable components include angled bars with padding. The angled bars are positionable in the rectangular recesses. In this manner pad squats (gridiron squats) may be performed. Note FIG. 6.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gridiron power machine system which has all of the advantages of the prior art exercise machines of known designs and configurations and none of the disadvantages.

It is another object of the present invention to provide a new and improved gridiron power machine system which may be easily and efficiently manufactured and marketed.

It is further object of the present invention to provide a new and improved gridiron power machine system which is of durable and reliable constructions.

An even further object of the present invention is to provide a new and improved gridiron power machine system which is susceptible of a low cost of manufacture with regard to both materials and labor, and which accordingly is then susceptible of low prices of sale to the consuming public, thereby making such gridiron power machine system economically available to the buying public.

Even still another object of the present invention is to provide a gridiron power machine system for being adapted to be reconfigured for providing users with a large number of lifting exercises, the lifting and reconfiguring of the system being done in a safe, convenient and economic manner.

Lastly, it is an object of the present invention to provide a new and improved gridiron power machine system. A support assembly has laterally spaced horizontal base rails. The support assembly has laterally spaced vertical rails. The vertical rails extend upwardly from the base rails. Pivot rails have interior ends and exterior ends. The interior ends are pivotally coupled with respect to the vertical rails. A cross bar is coupled to the pivot rails adjacent to the exterior ends. A plate is coupled to the pivot rails adjacent to the interior ends. The plate has recesses. The recesses receive and support attachments.

These together with other objects of the invention, along with the various features of safety and novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the system taken along line 3-3 of FIG. 1.

FIG. 4 is a perspective illustration of an alternate embodiment of the invention.

FIG. 5 is a perspective illustration similar to the FIG. 4 alternate embodiment and fitted with linear extensions.

FIG. 6 is a perspective illustration similar to the FIG. 4 alternate embodiment and fitted with angled extensions.

FIG. 7 is a perspective illustration similar to the FIG. 4 alternate embodiment and fitted with an adjustable bench.

FIG. 8 is a plan view of the system taken along line 8-8 of FIG. 7.

FIG. 9 is a perspective illustration of another alternate embodiment of the invention.

FIG. 10 is a perspective illustration of a final alternate embodiment of the invention.

The same reference numerals refer to the same parts throughout the various Figures.

DESCRIPTION OF THE PREFERRED EMBODIMENT

Figure 1:
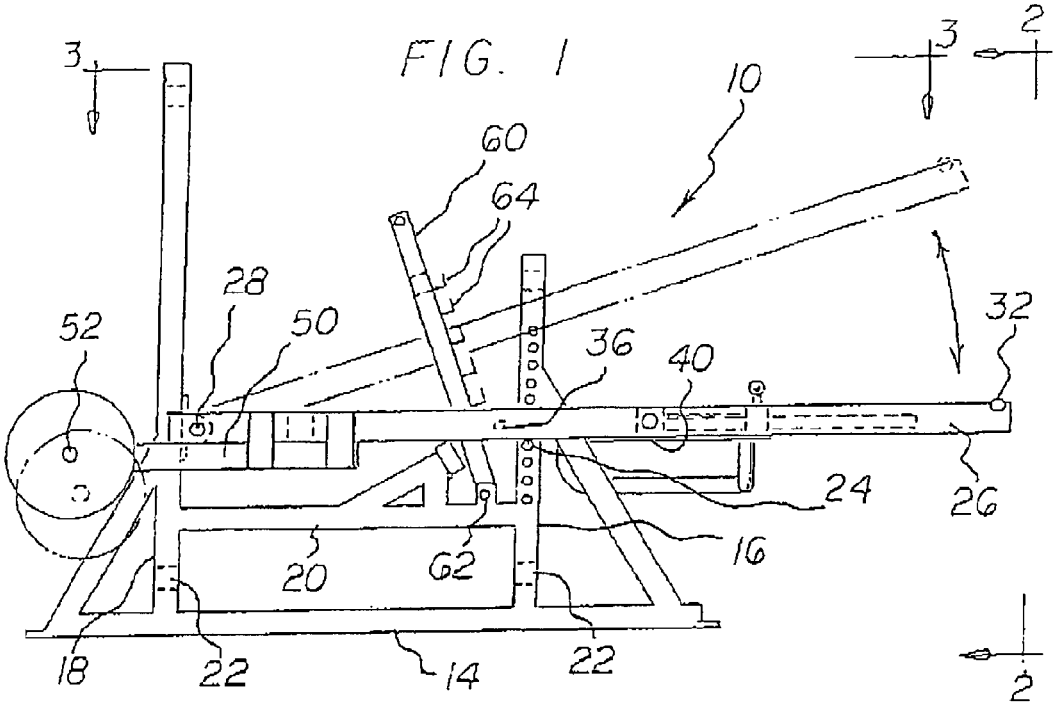
FIG. 1 is a side elevational view of a gridiron power machine system constructed in accordance with the principles of the present invention.
Figure 2:
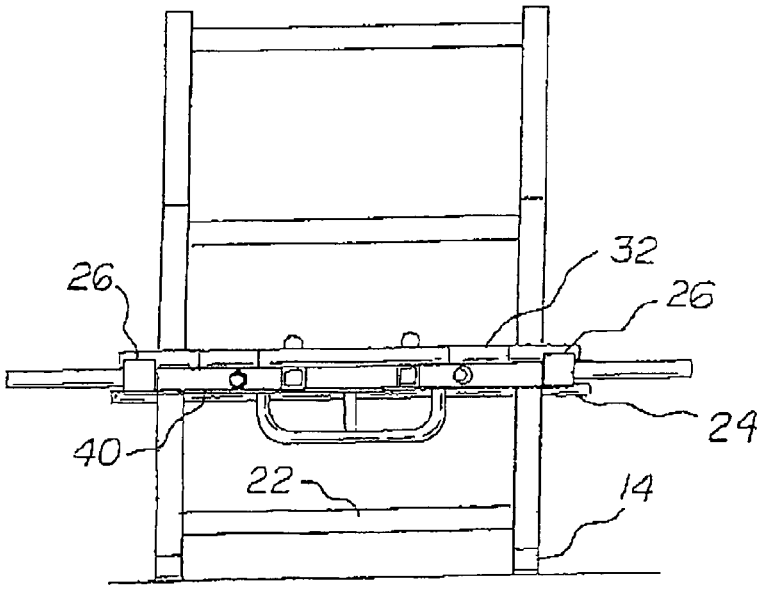
FIG. 2 is a front elevational view of the system taken along line 2-2 of FIG. 1.

With reference now to the drawings, and in particular to FIG. 1 thereof, the preferred embodiment of the new and improved gridiron power machine system embodying the principles and concepts of the present invention and generally designated by the reference numeral 10 will be described.

The present invention, the gridiron power machine system 10 is comprised of a plurality of components. Such components in their broadest context include a support assembly, pivot rails, a cross bar and a plate. Such components are individually configured and correlated with respect to each other so as to attain the desired objective.

First provided is a support assembly. The support assembly has laterally spaced horizontal base rails 14. The base rails are positionable on a ground surface. The support assembly also has laterally spaced vertical front rails 16 which houses a safety rod 24 to catch the pivot rails. The support assembly has laterally spaced vertical rear rails 18. The rear rails extend upwardly from the base rails. The support assembly also has horizontal elevated rails 20. The elevated rails are provided above and parallel with the base rails. The elevated rails couple the vertical front rails and vertical rear rails. The support assembly also has horizontal crossing rails 22. The crossing rails are provided at an elevation between the base rails and elevated rails perpendicular to both the base rails and the elevated rails. In this manner the vertical front rails are coupled to vertical rear rails.

A pair of laterally spaced pivot rails 26 is provided. The pivot rails have interior ends and exterior ends. A rear pivot pin 28 is provided. The rear pivot pin pivotally couples the interior ends of the pivot rails to the vertical rear rails.

Provided next is a grasping cross bar 32. The grasping cross bar is coupled to the pivot rails adjacent to the exterior ends. The grasping cross bar is adapted to be grasped by the user. The grasping cross bar is further adapted to be lifted for exercise purposes. The exercises include a shoulder press, lineman combine press, back squat, dead lift, hand clean, bentover row and bench press.

A supplemental cross bar 36 is provided. The supplemental cross bar is coupled to the pivot rails intermediate the exterior ends and interior ends of the pivot rails.

A plate 40 is provided. The plate is coupled to the pivot rails intermediate the supplemental cross bar and the exterior ends of the pivot rails. The plate has an outwardly facing edge 42. The plate has circular recesses 44. The plate also has rectangular recesses 46. The plate is adapted to be lifted. In this manner, vertically angled leg presses may be performed. Note FIGS. 4 and 5.

A counter weight assembly 50 is provided next. The counter weight assembly is attached to the pivot rails between the interior ends and exterior ends. The counter weight assembly extends rearwardly from the interior ends of the pivot rails. The counter weight assembly includes outwardly extending cylindrical rods 52.

Supplemental rods 56 are provided next. The supplemental rods extend outwardly from the pivot rails. In this manner supplemental weights are received and supported. A plurality of weights are adapted to be selectively positioned on the cylindrical rods and supplemental rods. In this manner the weight to be lifted may be varied.

Further provided are pivotable locking rails 60. The pivotable locking rails have upper and lower ends. Front pivot pins 62 are provided. The front pivot pins couple the lower ends of the pivotable locking rails to the elevated rails adjacent to the vertical front rails. Each locking rail has a plurality of L-shaped fingers 64. The L-shaped fingers are adapted to receive and retain the supplemental cross bar. In this manner the grasping bar may be retained at a preselected elevation. When lifted, the pivotable locking rail automatically falls back out of the way, making it an automatic un-racking system, A.U.S.

Provided last are detachable components. The detachable components include longitudinal cylindrical bars 72. The longitudinal cylindrical bars are positionable in the circular recesses. In this manner pole deads and pole shrugs may be performed. Note FIG. 3. The detachable components include linear bars with padding 74. The linear bars are positionable in the rectangular recesses. In this manner lineman plys and lineman squats may be performed. Note FIG. 5. The detachable components include angled bars with padding 76. The angled bars are positionable in the rectangular recesses. In this manner pad squats (gridiron squats) may be performed. Note FIG. 6.

The first alternate embodiment 100 of the present invention is illustrated in FIG. 4. The support assembly includes horizontal rails 104. The support assembly includes vertical rails 106. The support assembly also includes angled rails 108. The support assembly further includes a bench 112.

The second alternate embodiment 200 of the present invention is illustrated in FIGS. 7 and 8. A bench 204 is provided. The bench has legs 206. The legs are adapted to be adjusted. In this manner the height of the bench may be varied. The width of the bench pad is 12 inches on one end and 14 inches on the other end to support larger users.

The last alternate embodiment 300 of the present invention is illustrated in FIGS. 9 and 10. Pivot rails 304 are provided. The pivot rails have interior ends and exterior ends. A grasping rod is provided adjacent to the exterior ends. The exterior ends have exteriorly extending members. The exteriorly extending members have transverse rods 308 which allows the user to perform back squats, power squats. An alternate pivotable locking rail with an L-shaped finger 312 is provided. The L-shaped finger is adapted to receive the transverse rods. Adjustment members 314 are provided. In this manner the height of the L-shaped finger may be varied. Further in this manner the height of the grasping rod may be varied. This alternate pivotable locking rod also un-racks automatically.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gridiron power machine system comprising:

a support assembly having laterally spaced horizontal base rails and laterally spaced vertical rails extending upwardly from the base rails;

pivot rails, the pivot rails having interior ends and exterior ends, the interior ends pivotally coupled with respect to the vertical rails;

a grasping bar coupled to the pivot rails adjacent to the exterior ends;

a plate coupled to the pivot rails adjacent to the interior ends, the plate being formed with recesses for receiving and supporting attachments; and pivotable locking rails having upper and lower ends, front pivot pins coupling the lower ends of the pivotable locking rails to the support assembly, each locking rail having a plurality of L-shaped fingers adapted to retain the grasping bar at a preselected elevation, thus allowing when the grasping bar is lifted the L-shaped fingers to automatically fall back out of the way, making the locking rails, the front pivot pins, the support assembly, the L-shaped fingers and the grasping bar an automatic unracking system A.U.S.

2. The system as set forth in claim 1 and further including:

a weight assembly attached to the pivot rails between the interior ends and exterior ends and extending rearwardly from the interior ends of the pivot rails.

3. The system as set forth in claim 1 and further including:

detachable components positionable within the recesses selected from the group consisting of longitudinal cylindrical bars, linear bars with padding and angled bars with padding.

4. A gridiron power machine system (10) adapted to be reconfigured for providing users with a large number of lifting exercises, the lifting and the reconfiguring of the system being done in a safe, convenient and economic manner, the system comprising in combination:

a support assembly having laterally spaced horizontal base rails (14) positionable on a ground surface, the support assembly also having laterally spaced vertical front rails (16) which receive a safety rod, and laterally spaced vertical rear rails (18) extending upwardly from the base rails, the support assembly also having horizontal elevated rails (20) above and parallel with the base rails coupling the vertical front rails and vertical rear rails, the support assembly also having horizontal crossing rails (22) at an elevation between the base rails and elevated rails perpendicular to both the base rails and the elevated rails for coupling the vertical front rails and vertical rear rails;

a pair of laterally spaced pivot rails (26), the pivot rails having interior ends and exterior ends, a rear pivot pin (28) pivotally coupling the interior ends of the pivot rails to the vertical rear rails;

a grasping cross bar (32) coupled to the pivot rails adjacent to the exterior ends, the grasping cross bar adapted to be grasped by the user and lifted for exercise purposes including a shoulder press, lineman combine press, back squat, dead lift, hand clean, bentover row and bench press;

a supplemental cross bar (36) coupled to the pivot rails intermediate the exterior ends and interior ends of the pivot rails;

a plate (40) coupled to the pivot rails intermediate the supplemental cross bar and the exterior ends of the pivot rails, the plate having an outwardly facing edge (42) with circular recesses (44) and rectangular recesses (46), the plate adapted to be lifted for vertical angled leg presses;

a counter weight assembly (50) attached to the pivot rails between the interior ends and exterior ends and extending rearwardly from the interior ends of the pivot rails, the counter weight assembly including outwardly extending cylindrical rods (52);

supplemental rods (56) extending outwardly from the pivot rails for the receipt and support of supplemental weights, a plurality of weights adapted to be selectively positioned on the cylindrical rods and supplemental rods to vary the weight to be lifted;

pivotable locking rails (60) having upper and lower ends, front pivot pins (62) coupling the lower ends of the pivotable locking rails to the elevated rails adjacent to the vertical front rails, each locking rail having a plurality of L-shaped fingers (64) adapted to receive and retain the supplemental cross bar for thereby retaining the grasping bar at a preselected elevation, thus allowing when lifted, to automatically fall back, out of the way, making it an automatic un-racking system, A.U.S.; and detachable components including longitudinal cylindrical bars (72) positionable in the circular recesses for pole dead and pole shrugs, linear bars with padding (74) positionable in the rectangular recesses for lineman plies and lineman squats, and angled bars with padding (76) positionable in the rectangular recesses for pad squats (gridiron squats).

* * * * *